US009156644B2

(12) United States Patent
Harada

(10) Patent No.: US 9,156,644 B2
(45) Date of Patent: Oct. 13, 2015

(54) PRINTING APPARATUS AND CONTROL METHOD THEREOF

(71) Applicant: CANON KABUSHIKI KAISHA, Tokyo (JP)

(72) Inventor: Takuto Harada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/265,976

(22) Filed: Apr. 30, 2014

(65) Prior Publication Data

US 2014/0339756 A1 Nov. 20, 2014

(30) Foreign Application Priority Data

May 14, 2013 (JP) ..... 2013-102594

(51) Int. Cl.

| | |
|---|---|
| ***B65H 5/22*** | (2006.01) |
| ***B65H 29/62*** | (2006.01) |
| ***B65H 43/04*** | (2006.01) |
| ***B65H 29/60*** | (2006.01) |
| ***B65H 31/24*** | (2006.01) |
| ***B65H 43/06*** | (2006.01) |
| ***G03G 15/00*** | (2006.01) |
| ***B65H 5/26*** | (2006.01) |

(52) U.S. Cl.

CPC ..... *B65H 29/62* (2013.01); *B65H 5/26* (2013.01); *B65H 29/60* (2013.01); *B65H 31/24* (2013.01); *B65H 43/04* (2013.01); *B65H 43/06* (2013.01); *G03G 15/5012* (2013.01); *B65H 2403/942* (2013.01); *B65H 2408/40* (2013.01); *B65H 2511/528* (2013.01); *B65H 2601/11* (2013.01); *B65H 2601/271* (2013.01); *B65H 2801/06* (2013.01); *G03G 15/70* (2013.01); *G03G 2215/00552* (2013.01); *G03G 2221/1675* (2013.01)

(58) Field of Classification Search

CPC ..... B65H 29/50; B65H 29/62; B65H 29/60; B65H 43/04; B65H 2220/03; B65H 2601/11; B65H 2601/271; B65H 2511/528

See application file for complete search history.

(56) References Cited

U.S. PATENT DOCUMENTS

| | | | | |
|---|---|---|---|---|
| 4,905,840 | A * | 3/1990 | Yuge et al. | 209/534 |
| 5,823,529 | A * | 10/1998 | Mandel et al. | 271/296 |
| 7,127,184 | B2 * | 10/2006 | Coriale et al. | 399/21 |
| 7,207,557 | B2 * | 4/2007 | Kaneko et al. | 270/58.08 |
| 2009/0166945 | A1 * | 7/2009 | Taguchi et al. | 270/37 |

(Continued)

FOREIGN PATENT DOCUMENTS

JP 2009-222794 A 10/2009

*Primary Examiner* — Howard Sanders

(74) *Attorney, Agent, or Firm* — Carter, DeLuca, Farrell & Schmidt, LLP

(57) ABSTRACT

A printing apparatus according to one aspect of this invention automatically discharges, of sheets remaining on a conveyance path when a sheet being conveyed jams, dischargeable sheets to one of a plurality of sheet retraction units. At this time, the printing apparatus detects the stacked state of sheets discharged to the sheet retraction unit. When the printing apparatus detects that the sheet retraction unit has become a predetermined state, it changes the discharge destination of sheets to be conveyed to the sheet retraction unit, thereby controlling not to further discharge a sheet to that sheet retraction unit. According to this control, when retracting sheets remaining on the conveyance path upon occurrence of a jam in the printing apparatus, occurrence of a new jam can be prevented.

6 Claims, 8 Drawing Sheets

(56) References Cited

U.S. PATENT DOCUMENTS

2012/0001387 A1* 1/2012 Mutsuno ..... 271/298
2013/0300056 A1* 11/2013 Kai ..... 271/262
2014/0241737 A1* 8/2014 Shirasaka ..... 399/20
2014/0334833 A1* 11/2014 Harada ..... 399/21

* cited by examiner

PRINTING APPARATUS AND CONTROL METHOD THEREOF

BACKGROUND OF THE INVENTION

1. Field of the Invention

The present invention relates to a printing apparatus and control method thereof.

2. Description of the Related Art

In a printing apparatus, when a sheet being conveyed on a sheet conveyance path jams (for example, paper jam), it is generally necessary to interrupt print processing and remove sheets remaining on the conveyance path. In this case, to resolve the occurred jam and resume the print processing, the user needs to remove not only the jammed sheet but also other sheets remaining on the conveyance path due to the interruption of the print processing. Japanese Patent Laid-Open No. 2009-222794 discloses a method in which, when a sheet being conveyed jams, a sheet, feed of which has already started and which remains on the conveyance path, is discharged (retracted) to an escape tray or the like without conveying it to a downstream apparatus.

In the above-described related art, however, when a sheet retraction unit serving as the retraction destination of sheets remaining on the conveyance path upon occurrence of a jam has already been nearly in the full stacked state, if a sheet is discharged to the sheet retraction unit, the sheet retraction unit may become the full stacked state during sheet discharge. As a result, a sheet to be discharged to the sheet retraction unit may further jam.

SUMMARY OF THE INVENTION

The present invention has been made to solve the above-described problem. The present invention provides a technique of preventing generation of a new jam when retracting sheets remaining on a conveyance path when a jam occurs in a printing apparatus.

According to one aspect of the present invention, there is provided a printing apparatus comprising: a plurality of sheet retraction units each configured to be used as a discharge destination of a sheet remaining on a conveyance path of the sheet when a sheet jams on the conveyance path; a discharge control unit configured to control to, when a sheet being conveyed through the conveyance path jams, discharge the sheet remaining on the conveyance path to a sheet retraction unit; a detection unit configured to detect a stacked state of sheets on the sheet retraction unit; and a change unit configured to, when the detection unit detects that the stacked state of sheets on the sheet retraction unit have become a predetermined state while the discharge control unit discharges the sheet remaining on the conveyance path, change the discharge destination of the sheet remaining on the conveyance path from the sheet retraction unit to another sheet retraction unit.

According to another aspect of the present invention, there is provided a printing apparatus comprising: at least one of sheet retraction units each configured to be used as a discharge destination of a sheet remaining on a conveyance path of the sheet when a sheet jams on the conveyance path; a detection unit configured to detect a stacked state of sheets on each of the sheet retraction units when a sheet being conveyed through the conveyance path jams; a notification unit configured to notify a user to remove stacked sheets from, out of the at least one of the sheet retraction units, a sheet retraction unit which is detected by the detection unit to have been in or nearly in a full stacked state; and a discharge control unit configured to, upon completion of removing sheets from the sheet retraction unit in or nearly in the full stacked state, discharge dischargeable sheets out of a plurality of sheets remaining on the conveyance path to a sheet retraction unit.

According to still another aspect of the present invention, there is provided a method of controlling a printing apparatus, the printing apparatus including a plurality of sheet retraction units each configured to be used as a discharge destination of a sheet remaining on a conveyance path of the sheet when a sheet jams on the conveyance path, the controlling method comprising steps of: controlling to, when a sheet being conveyed through the conveyance path jams, discharge the sheet remaining on the conveyance path to a sheet retraction unit; detecting a stacked state of sheets on the sheet retraction unit; and when the stacked state of sheets on the sheet retraction unit is detected in the detecting step to have become a predetermined state while the sheet remaining on the conveyance path is discharged in the discharge control, changing the discharge destination of the sheet remaining on the conveyance path from the sheet retraction unit to another sheet retraction unit.

The present invention can provide a technique of reducing the labor of the user required to remove sheets remaining on a conveyance path from a printing apparatus when a jam occurs in the printing apparatus.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

<Arrangement of Printing Apparatus 100>

Figure 1:
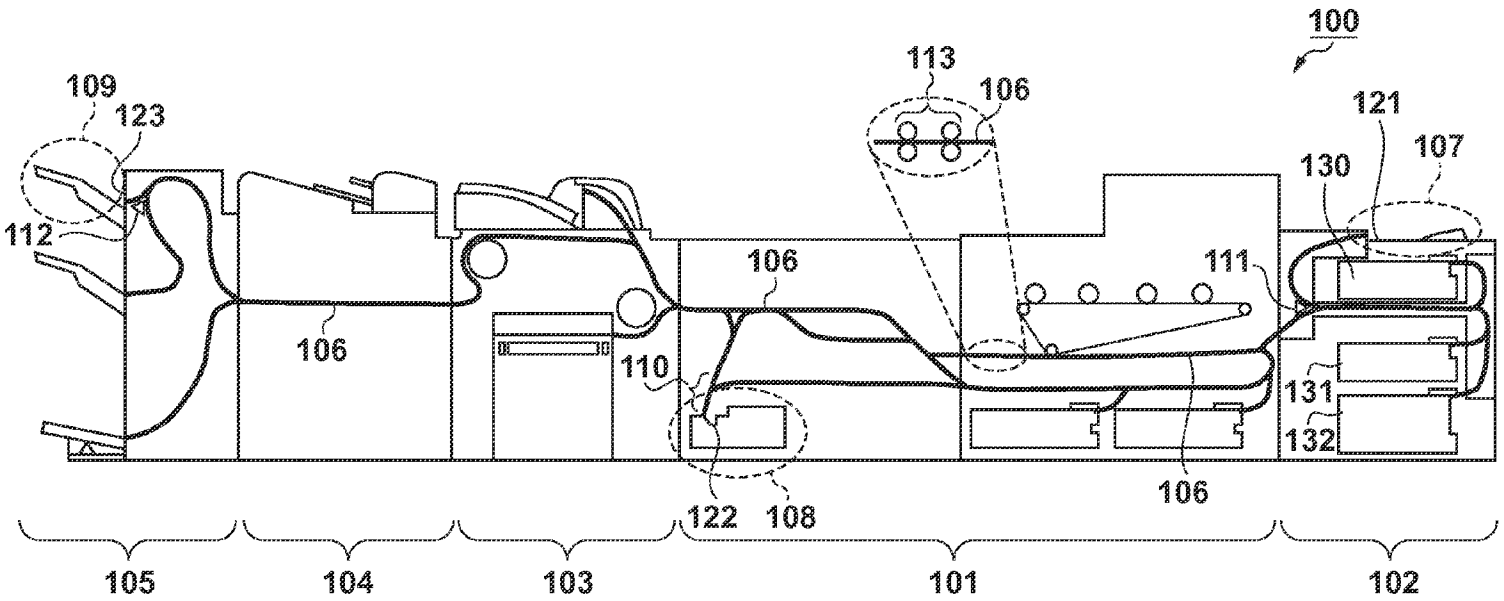
FIG. 1 is a sectional view showing the overall arrangement of a printing apparatus 100 according to an embodiment of the present invention.

FIG. 1 is a sectional view showing the overall arrangement of a printing apparatus according to an embodiment of the present invention. In the embodiment, a printing apparatus 100 including a printing apparatus main body 101 and accessories 102 to 105 will be explained as an application example of the present invention. The accessories 102 to 105 are generally optional apparatuses which are connected to the printing apparatus main body 101. Necessary optional apparatuses change depending on the arrangement of the printing apparatus main body 101. For example, the printing apparatus main body 101 may not require an optional apparatus or may require at least one optional apparatus out of optional apparatuses of the feed system and discharge system. The embodiment will exemplify the printing apparatus 100 having an arrangement in which the feed accessory 102 is connected as an optional apparatus of the feed system to the printing apparatus main body 101, and the discharge accessories 103 to 105 are connected as optional apparatuses of the discharge system to the printing apparatus main body 101.

The feed accessory 102 includes a plurality of feed units 130 to 132 each serving as a sheet feed source in which sheets to undergo print processing are stored. The feed accessory 102 separates one by one a plurality of sheets stored in the feed units 130 to 132 in accordance with an instruction from the printing apparatus main body 101, and feeds the separated sheets sequentially one by one onto a conveyance path 106. The feed accessory 102 can continuously feed a plurality of sheets.

The discharge accessories 103 to 105 are apparatuses each serving as a discharge destination to which a sheet having undergone print processing in the printing apparatus main body 101 is finally discharged. The discharge accessories 103 to 105 are, for example, sheet processing apparatuses which perform post-processing such as bookbinding or stapling on sheets having undergone print processing, or large-volume stackers for stacking sheets having undergone print processing.

In the printing apparatus 100, a sheet fed from the feed accessory 102 is conveyed toward the printing apparatus main body 101 on the conveyance path 106. The printing apparatus main body 101 performs print processing to print an image on one or two surfaces of the sheet conveyed on the conveyance path 106. The printing apparatus main body 101 conveys, toward the discharge accessories 103 to 105, the sheet bearing the image printed on one or the images printed on two surfaces.

In the printing apparatus 100, a plurality of sheet retraction units 107 to 109 are arranged at different positions midway on the conveyance paths 106 along the conveyance paths 106 for a fed sheet that extend from the sheet feed source to the discharge destination of a sheet having undergone print processing. The sheet retraction units 107 to 109 are used as the retraction destinations of sheets remaining on the conveyance paths 106 when a sheet jams on the conveyance path 106 during execution of print processing. More specifically, the sheet retraction units 107 to 109 are used (as retraction destinations for retracting sheets from the conveyance paths 106) to retract dischargeable sheets out of a plurality of sheets remaining on the conveyance paths 106. In the printing apparatus 100, the sheet retraction units 107, 108, and 109 are arranged in the feed accessory 102, printing apparatus main body 101, and discharge accessory 105, respectively. In the embodiment, no such sheet retraction unit is arranged in the discharge accessories 103 and 104.

The sheet retraction unit 107 is arranged midway along the conveyance path 106 in the feed accessory 102. The sheet retraction unit 107 is generally used to, upon detecting generation of double feed in which a plurality of sheets are conveyed from one of the feed units 130 to 132 while they are not separated but overlap each other, discharge the double fed sheets. The feed accessory 102 can discharge a sheet on the conveyance path 106 to the sheet retraction unit 107 by operating (opening) a flapper 111 for guiding a sheet conveyed on the conveyance path 106 to the sheet retraction unit 107. In the embodiment, when occurrence of a jam is detected and the feed accessory 102 accepts a sheet retraction instruction from the printing apparatus main body 101, the feed accessory 102 operates the flapper 111 to discharge a sheet on the conveyance path 106 to the sheet retraction unit 107.

The sheet retraction unit 108 is arranged midway along the conveyance path 106 in the printing apparatus main body 101. Rollers 110 are used on the conveyance path 106 to convey a sheet to a reverse path for double-sided printing or to the sheet retraction unit 108. When performing double-sided printing on a sheet, the printing apparatus main body 101 reversely rotates the rollers 110 while the rollers 110 pinch the sheet, and feeds the sheet to the reverse path. With this operation, the printing apparatus main body 101 reverses the printing surface of the sheet. By rotating the rollers 110, the printing apparatus main body 101 can feed a sheet on the conveyance path 106 to the sheet retraction unit 108 and discharge it to the sheet retraction unit 108.

The sheet retraction unit 109 is arranged midway along the conveyance path 106 in the discharge accessory 105. In general, a printed material having undergone test print processing to prompt the user to check the printing state is discharged to the sheet retraction unit 109. That is, the sheet retraction unit 109 is used to retraction a printed material not used as a final product. The discharge accessory 105 can discharge a sheet on the conveyance path 106 to the sheet retraction unit 109 by operating (opening) a flapper 112 for guiding a sheet conveyed on the conveyance path 106 to the sheet retraction unit 109. In the embodiment, when occurrence of a jam is detected and the discharge accessory 105 accepts a sheet retraction instruction from the printing apparatus main body 101, the discharge accessory 105 operates the flapper 112 to discharge a sheet on the conveyance path 106 to the sheet retraction unit 109.

As shown in FIG. 1, the sheet retraction units 107 to 109 include sensors 121 to 123 for detecting the stacked state (for example, stacking amount) of sheets discharged from the conveyance path 106. By using the sensors 121 to 123, the printing apparatus 100 can detect that, for example, the sheet retraction units 107 to 109 are in or nearly in the full stacked state.

In the printing apparatus 100, a plurality of sensors are arranged at different positions along the conveyance paths 106. These sensors are arranged in the printing apparatus main body 101, feed accessory 102, and discharge accessories 103 to 105, respectively. These sensors are used to specify the positions of sheets on the conveyance paths 106.

In the printing apparatus 100, many rollers for conveying sheets on the conveyance paths 106 are arranged along the conveyance paths 106, in addition to the rollers 110 arranged in the printing apparatus main body 101. These rollers will be referred to as a roller group 113.

Figure 2:
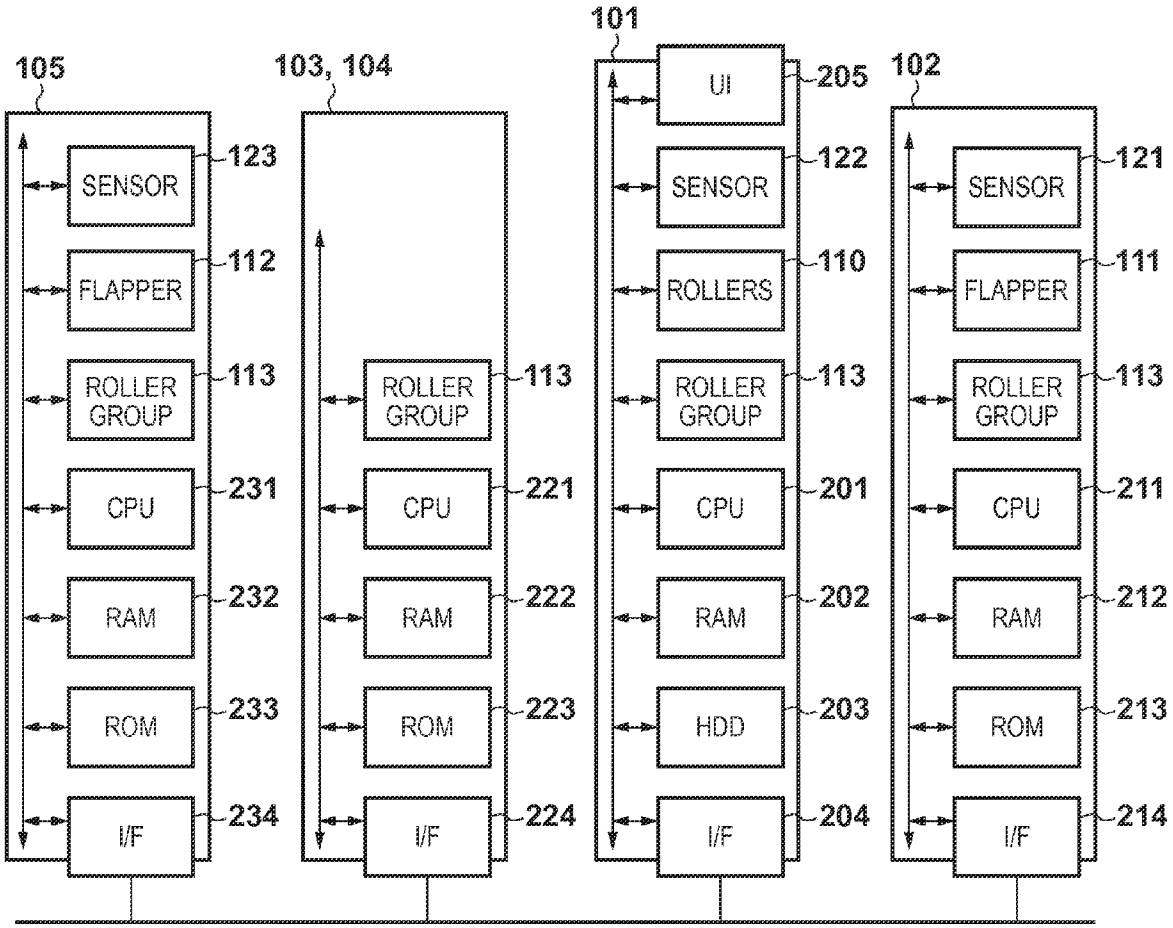
FIG. 2 is a block diagram showing the schematic hardware arrangement of the printing apparatus 100 according to the embodiment of the present invention.

FIG. 2 is a block diagram showing the schematic hardware arrangement of the printing apparatus 100. FIG. 2 shows devices particularly associated with sheet discharge processing according to the embodiment, out of devices in the printing apparatus 100. The discharge accessories 103 and 104, which do not have the function of retracting a sheet, have different functions. However, the discharge accessories 103 and 104 are common in that they have neither a sheet retraction unit for retracting a sheet on the conveyance path 106, nor a flapper (like the flappers 111 and 112) for retracting a sheet. Thus, FIG. 2 shows a common arrangement as for the discharge accessories 103 and 104.

The printing apparatus main body 101 includes a CPU 201 which controls the overall operation of the printing apparatus 100 including not only the printing apparatus main body 101 but also the feed accessory 102 and discharge accessories 103 to 105. The printing apparatus main body 101 includes a RAM 202, hard disk drive (HDD) 203, interface (I/F) 204, and user interface (UI) 205. The RAM 202 temporarily stores software (program) to be executed by the CPU 201, and data to be used by the CPU 201. The HDD 203 stores software and data for the operation of the printing apparatus main body 101. The I/F 204 is a communication interface for communicating with the feed accessory 102 and discharge accessories 103 to 105. The UI 205 functions as an input interface for allowing the user to input an instruction, and a display interface for displaying various kinds of information such as operation information of the printing apparatus main body 101 and notification information to the user.

The feed accessory 102 includes a CPU 211, RAM 212, ROM 213, and I/F 214, and their functions are the same as those of the CPU 201, RAM 202, HDD 203, and I/F 204 described above. Each of the discharge accessories 103 and 104 includes a CPU 221, RAM 222, ROM 223, and I/F 224, and their functions are the same as those of the CPU 201, RAM 202, HDD 203, and I/F 204 described above. The discharge accessory 105 includes a CPU 231, RAM 232, ROM 233, and I/F 234, and their functions are also the same as those of the CPU 201, RAM 202, HDD 203, and I/F 204 described above.

Figure 3:
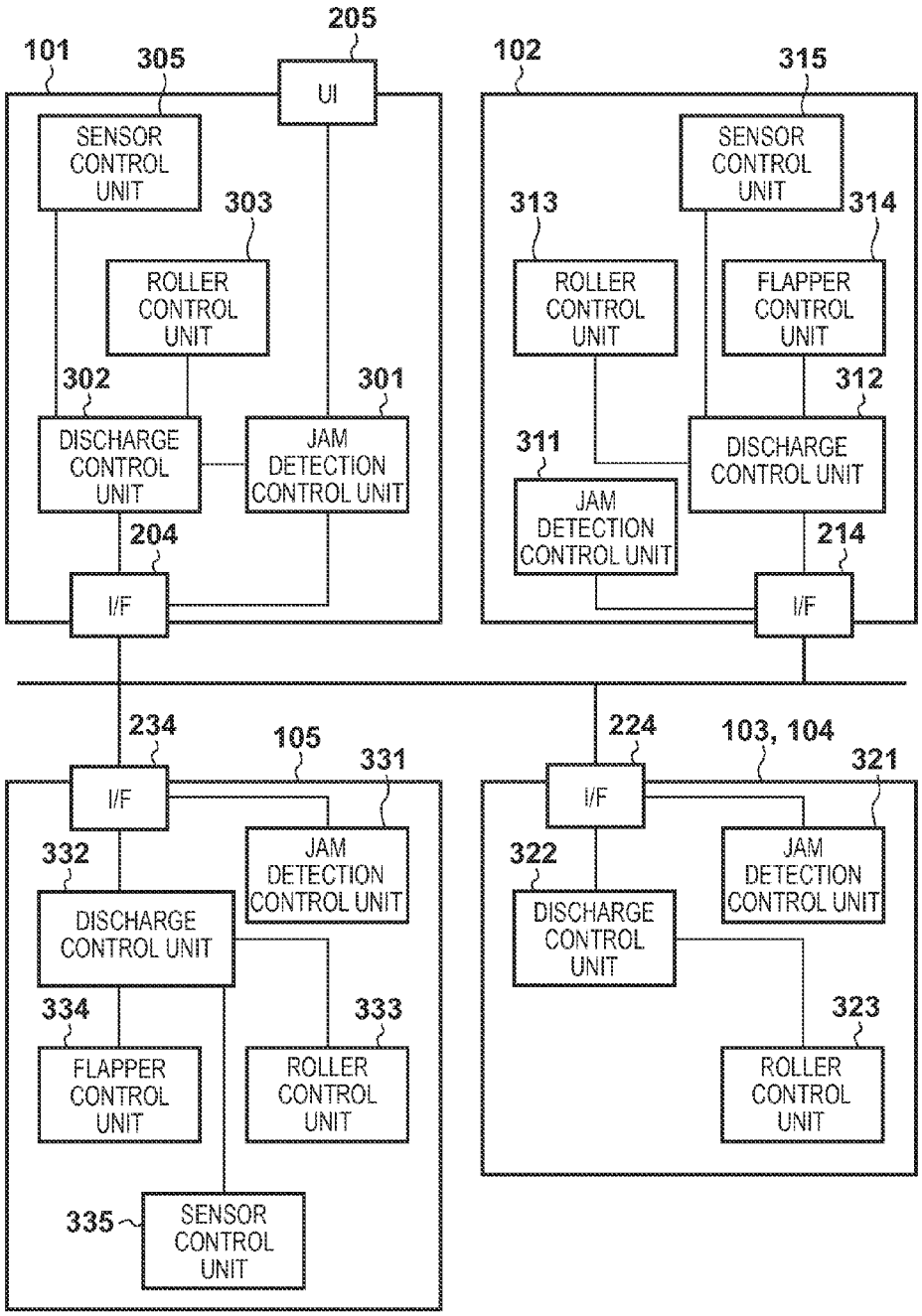
FIG. 3 is a block diagram showing the schematic software arrangement of the printing apparatus 100 according to the embodiment of the present invention.

FIG. 3 is a block diagram showing the software arrangement of the printing apparatus 100. FIG. 3 shows software modules particularly associated with sheet discharge processing according to the embodiment, out of software modules in the printing apparatus 100. The functions of the respective blocks shown in FIG. 3 are implemented by the CPUs 201, 211, 221, and 231 in the printing apparatus main body 101, feed accessory 102, and discharge accessories 103 to 105, respectively. More specifically, the CPUs 201, 211, 221, and 231 read out control programs stored in the HDD 203 and the ROMs 213, 223, and 233 to the RAMs 202, 212, 222, and 232, and execute them, thereby implementing the functions of the respective blocks shown in FIG. 3. Similar to FIG. 2, FIG. 3 shows a common arrangement as for the discharge accessories 103 and 104.

In the printing apparatus main body 101, when a sheet being conveyed on the conveyance path 106 in the printing apparatus main body 101 jams during execution of print processing, a jam detection control unit 301 detects the occurrence of the jam. A discharge control unit 302 controls discharge processing to discharge sheets remaining on the conveyance path 106 upon occurrence of a jam to the sheet retraction unit 108. A roller control unit 303 controls the rollers 110 and the roller group 113 of the printing apparatus main body 101. A sensor control unit 305 controls the sensor 122 arranged in the sheet retraction unit 108. The sensor control unit 305 can detect the stacked state of sheets on the sheet retraction unit 108 by using the sensor 122.

In the feed accessory 102, when a sheet being conveyed on the conveyance path 106 in the feed accessory 102 jams during execution of print processing, a jam detection control unit 311 detects the occurrence of the jam. Further, the jam detection control unit 311 transmits, to the jam detection control unit 301, a signal representing that the occurrence of the jam has been detected. In accordance with an instruction from the discharge control unit 302, a discharge control unit 312 controls discharge processing to discharge sheets remaining on the conveyance path 106 upon occurrence of a jam to the sheet retraction unit 107. A roller control unit 313 controls the roller group 113 of the feed accessory 102. A flapper control unit 314 controls the flapper 111. A sensor control unit 315 controls the sensor 121 arranged in the sheet retraction unit 107. The sensor control unit 315 can detect the stacked state of sheets on the sheet retraction unit 107 by using the sensor 121.

In each of the discharge accessories 103 and 104, when a sheet being conveyed on the conveyance path 106 in each of the discharge accessories 103 and 104 jams during execution of print processing, a jam detection control unit 321 detects the occurrence of the jam. Further, the jam detection control unit 321 transmits, to the jam detection control unit 301, a signal representing that the generation of the jam has been detected. In accordance with an instruction from the discharge control unit 302, a discharge control unit 322 controls discharge processing to discharge sheets remaining on the conveyance path 106 upon occurrence of a jam to the sheet retraction unit 109. A roller control unit 323 controls the roller group 113 of each of the discharge accessories 103 and 104.

In the discharge accessory 105, when a sheet being conveyed on the conveyance path 106 in the discharge accessory 105 jams during execution of print processing, a jam detection control unit 331 detects the occurrence of the jam. Further, the jam detection control unit 331 transmits, to the jam detection control unit 301, a signal representing that the generation of the jam has been detected. In accordance with an instruction from the discharge control unit 302, a discharge control unit 332 controls discharge processing to discharge sheets remaining on the conveyance path 106 upon occurrence of a jam to the sheet retraction unit 109. A roller control unit 333 controls the roller group 113 of the discharge accessory 105. A flapper control unit 334 controls the flapper 112. A sensor control unit 335 controls the sensor 123 arranged in the sheet retraction unit 109. The sensor control unit 335 can detect the stacked state of sheets on the sheet retraction unit 109 by using the sensor 123.

<Conveyance Control of Sheet Upon Occurrence of Jam>

When a sheet being conveyed on the conveyance path 106 jams, the printing apparatus 100 generally interrupts print processing in execution. As a result, several sheets remain on the conveyance paths 106. In this case, to resolve the occurred jam and allow the printing apparatus 100 to resume the print processing, the user needs to remove not only the jammed sheet, but also other sheets remaining on the conveyance paths 106. This work is cumbersome. In particular, as the conveyance path 106 becomes longer, the number of sheets to be removed upon occurrence of a jam increases, and the sheet removal work becomes more troublesome. In such a case, it is desirable to minimize the labor of the user.

To solve the above-described problem, when a sheet jams on the conveyance path 106, the printing apparatus 100 according to the embodiment automatically discharges sheets remaining on the conveyance paths 106 to the sheet retraction units 107 to 109 as many as possible. More specifically, when a jam occurs, the printing apparatus 100 discharges, of a plurality of sheets remaining on the conveyance paths 106, dischargeable sheets to sheet retraction units arranged downstream in the conveyance direction with respect to positions where the sheets remain. Hence, the sheets remaining on the conveyance paths 106 can be removed at once from the sheet retraction units 107 to 109 as many as possible, thereby reducing the labor of the user. An example of sheet conveyance control according to the embodiment that is executed when a sheet on the conveyance path 106 jams in the printing apparatus 100 will be explained with reference to FIGS. 4A to 4C.

Figure 4A:
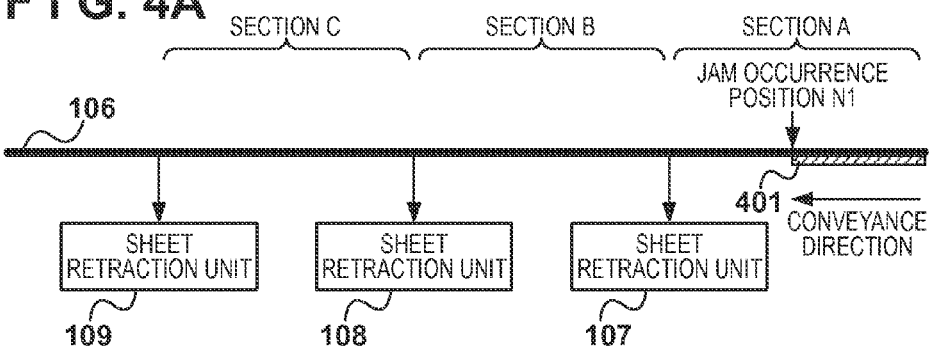
FIGS. 4A, 4B, and 4C are conceptual views showing examples of sheet conveyance control according to the embodiment of the present invention.
Figure 4B:
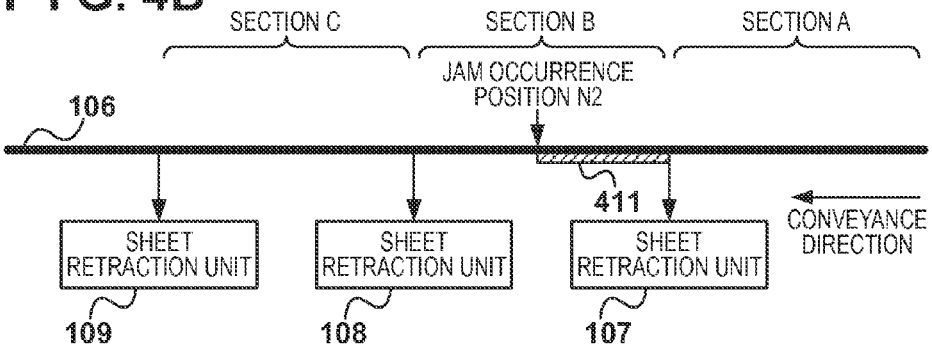
Figure 4C:
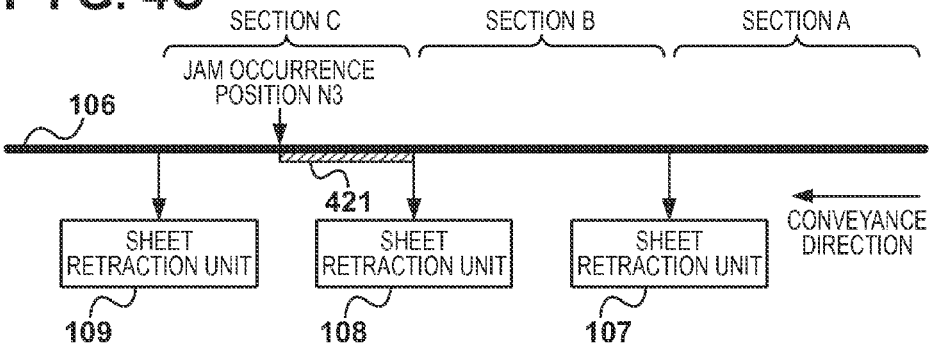

FIGS. 4A to 4C show the conveyance paths 106 extending from the sheet feed source (the feed units 130 to 132) to the discharge destination (the discharge accessory 105 in this case), and the sheet retraction units 107 to 109 arranged midway on the conveyance paths 106 along the conveyance paths 106. A section from the feed source to the sheet retraction unit 107 is defined as a section A. A section from the sheet retraction unit 107 to the sheet retraction unit 108 is defined as a section B. A section from the sheet retraction unit 108 to the sheet retraction unit 109 is defined as a section C. Also, FIGS. 4A, 4B, and 4C correspond to cases in which sheets being conveyed jam in the sections A, B, and C, respectively. FIGS. 4A, 4B, and 4C show jam occurrence positions N1, N2, and N3, respectively.

(Case in which Jam Occurs in Section A)

FIG. 4A shows a case in which a sheet jams at the position N1 in the section A of the conveyance path 106. In this case, the printing apparatus 100 cannot convey, to the downstream side in the conveyance direction from the position N1, a sheet remaining in an upstream section 401 in the conveyance direction with respect to the position N1 on the conveyance path 106. To the contrary, the printing apparatus 100 can discharge, to one of the sheet retraction units 107 to 109 serving as the retraction destination, each sheet remaining on the downstream side in the conveyance direction with respect to the position N1 on the conveyance path 106 without disturbing the sheet by the jammed sheet. For example, sheets respectively remaining in the section A except for the section 401, the section B, and the section C are automatically discharged to the nearest sheet retraction units 107, 108, and 109 on the downstream side in the conveyance direction from positions where the respective sheets remain.

(Case in which Jam Occurs in Section B)

FIG. 4B shows a case in which a sheet jams at the position N2 in the section B of the conveyance path 106. In this case, the printing apparatus 100 cannot convey, to the downstream side in the conveyance direction from the position N2, a sheet remaining in an upstream section 411 in the conveyance direction with respect to the position N2 on the conveyance path 106. To the contrary, the printing apparatus 100 can discharge, to the sheet retraction unit 108 or 109 serving as the retraction destination, each sheet remaining on the downstream side in the conveyance direction with respect to the position N2 on the conveyance path 106 without disturbing the sheet by the jammed sheet. For example, sheets respectively remaining in the section B except for the section 411 and the section C are automatically discharged to the nearest sheet retraction units 108 and 109 on the downstream side in the conveyance direction from positions where the respective sheets remain. Further, even each sheet remaining in the section A can be discharged to, as the retraction destination, the nearest sheet retraction unit 107 on the downstream side in the conveyance direction without disturbing the sheet by the jammed sheet.

(Case in which Jam Occurs in Section C)

FIG. 4C shows a case in which a sheet jams at the position N3 in the section C of the conveyance path 106. In this case, the printing apparatus 100 cannot convey, to the downstream side in the conveyance direction from the position N3, a sheet remaining in an upstream section 421 in the conveyance direction with respect to the position N3 on the conveyance path 106. To the contrary, the printing apparatus 100 can discharge, to the sheet retraction unit 109 serving as the retraction destination, each sheet remaining on the downstream side in the conveyance direction with respect to the position N3 on the conveyance path 106 without disturbing the sheet by the jammed sheet. Further, the printing apparatus 100 can discharge even sheets remaining in the sections A and B to the nearest sheet retraction units 107 and 108 serving as the retraction destinations on the downstream side in the conveyance direction from positions where the respective sheets remain, without disturbing the sheets by the jammed sheet.

In all the cases of FIGS. 4A to 4C, a sheet remaining on the downstream side in the conveyance direction from the position of the sheet retraction unit 109 on the conveyance path 106 is discharged to a final discharge destination (the discharge accessory 105).

In this manner, in the examples shown in FIGS. 4A to 4C, the printing apparatus 100 specifies a sheet which can be conveyed to one of the sheet retraction units 107 to 109 without passing through the jam occurrence positions N1 to N3 when each sheet remaining on the conveyance path 106 is conveyed from its position in the conveyance direction. Then, the printing apparatus 100 sets specified sheets as sheets dischargeable to the sheet retraction units 107 to 109. For example, in FIGS. 4A to 4C, sheets remaining in the sections except for the sections 401, 411, and 421 are specified as sheets dischargeable to the sheet retraction units 107 to 109. Further, the printing apparatus 100 decides one of the sheet retraction units 107 to 109 as the retraction destination of each specified sheet, and automatically discharges each sheet to the decided sheet retraction unit.

The sheet retraction units 107 to 109 have a predetermined stackability. If sheets are kept discharged to the sheet retraction units 107 to 109, the stacked state of sheets on each sheet retraction unit reaches the full stacked state eventually. Especially when a jam occurs, if one sheet retraction unit reaches the full stacked state while dischargeable sheets are automatically discharged to the sheet retraction units 107 to 109 as described above, a sheet to be discharged to this sheet retraction unit may further jam.

In the embodiment, discharge control corresponding to the stacked states of sheets on the sheet retraction units 107 to 109 is executed to prevent occurrence of a new jam while sheets remaining on the conveyance paths 106 are discharged to the sheet retraction units 107 to 109 upon occurrence of a jam.

As the first control example, while dischargeable sheets remaining on the conveyance paths are discharged, the printing apparatus 100 detects the stacked states of the sheets discharged to the respective sheet retraction units by using the sensors 121 to 123 arranged in the sheet retraction units 107 to 109. When the printing apparatus 100 detects that one of the sheet retraction units 107 to 109 has become the full stacked state, it controls not to further discharge a sheet to this sheet retraction unit. More specifically, the printing apparatus 100 changes the discharge destination of a sheet to be conveyed to the sheet retraction unit which has become the full stacked state, to a sheet retraction unit arranged downstream in the conveyance direction with respect to the sheet retraction unit which has become the full stacked state. Accordingly, it can be prevented to further discharge a sheet to the sheet retraction unit which has become the full stacked state, as well as occurrence of an additional jam owing to the full stacked state of the sheet retraction unit can be prevented.

Alternatively, even by the following second control example, occurrence of a jam owing to the full stacked state of the sheet retraction unit can be prevented. More specifically, when a sheet being conveyed jams, the printing apparatus 100 uses the sensors 121 to 123 to detect the stacked states of sheets in the respective sheet retraction units 107 to 109. The printing apparatus 100 notifies the user that stacked sheets should be removed from the sheet retraction unit which is detected to have already been in or nearly in the full stacked state. Upon completion of removing sheets, the printing apparatus 100 discharges dischargeable sheets remaining on the conveyance paths 106 to the sheet retraction units 107 to 109. Note that nearly the full stacked state is a state in which when a jam occurs next time and a sheet is discharged to a specific sheet retraction unit, the specific sheet retraction unit may become the full stacked state. Thus, the sheet retraction units 107 to 109 can be prevented from becoming the full stacked state during execution of sheet discharge processing, as well as occurrence of a jam owing to the full stacked state of the sheet retraction unit can be prevented.

<Print Processing of Printing Apparatus 100>

An example of sheet conveyance control upon occurrence of a jam that is executed in the printing apparatus 100 according to the embodiment will be explained with reference to FIGS. 5 to 8. Processes in the respective steps of FIGS. 5 to 8 are implemented in the printing apparatus 100 (printing apparatus main body 101) by reading out control programs stored in the HDD 203 to the RAM 202 and executing them by the CPU 201 of the printing apparatus main body 101. Note that FIGS. 6 and 7 correspond to the first control example described above, and FIG. 8 corresponds to the second control example described above.

Figure 5:
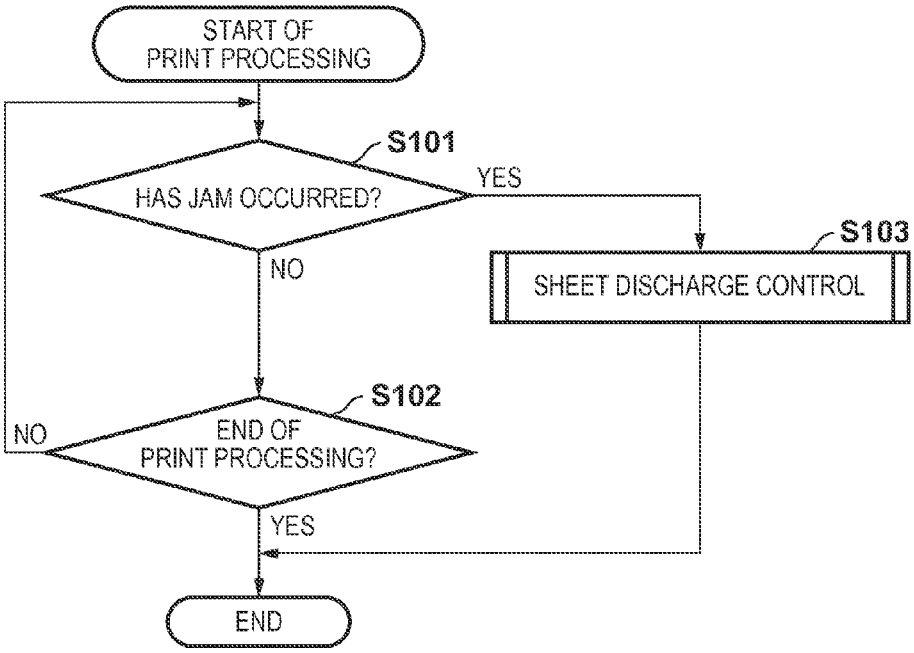
FIG. 5 is a flowchart showing the sequence of print processing to be executed by the printing apparatus 100 (a printing apparatus main body 101) according to the embodiment of the present invention.

FIG. 5 is a flowchart showing the sequence of print processing to be executed by the printing apparatus 100 (printing apparatus main body 101) according to the embodiment. When the CPU 201 starts print processing on sheets in the printing apparatus 100, it feeds sheets from the feed units 130 to 132 of the feed accessory 102 to the conveyance path 106, and starts conveying the sheets in a predetermined conveyance direction on the conveyance path 106. For example, the CPU 201 starts print processing based on an instruction (print job) input by the user via the UI 205, or an instruction (print job) received from an external apparatus via a network (not shown).

In step S101, the jam detection control unit 301 (CPU 201) determines whether a sheet has jammed on the conveyance path 106 in one of the printing apparatus main body 101, feed accessory 102, and discharge accessories 103 to 105 during execution of print processing. If the sensor in the printing apparatus main body 101 out of the aforementioned plurality of sensors arranged along the conveyance paths 106 detects that one of a plurality of sheets being conveyed on the conveyance path 106 has jammed, it outputs a signal indicative of this to the jam detection control unit 301. Similarly, if the sensors arranged in the feed accessory 102 and discharge accessories 103 to 105 detect occurrence of jams, they output signals indicative of this to the jam detection control units 311, 321, and 331. The jam detection control units 311, 321, and 331 transmit the signals to the jam detection control unit 301.

In step S101, based on the signals received from the plurality of sensors described above, the jam detection control unit 301 detects the occurrence of the jam of one of the sheets being conveyed on the conveyance paths 106. If the jam detection control unit 301 determines in step S101 that the jam has occurred, it advances the process to step S103. If the jam detection control unit 301 determines that no jam has occurred, it advances the process to step S102.

In step S102, the CPU 201 determines whether the print processing based on the print job has ended. If the CPU 201 determines that all the print processing defined by the print job has ended, it ends the process. If the CPU 201 determines that all the print processing has not ended, it returns the process to step S101 to continue the print processing.

If the process advances from step S101 to step S103, the CPU 201 interrupts the print processing, and executes discharge control to automatically discharge (retract), of sheets remaining on the conveyance paths 106, dischargeable sheets to the sheet retraction units 107 to 109. At this time, the CPU 201 executes discharge control to the sheet retraction units 107 to 109 for dischargeable sheets while a jammed sheet remains on the conveyance path 106. As examples of the discharge control to be executed in step S103, the first control example (FIGS. 6 and 7) and the second control example (FIG. 8) will be explained.

First Control Example

Figure 6:
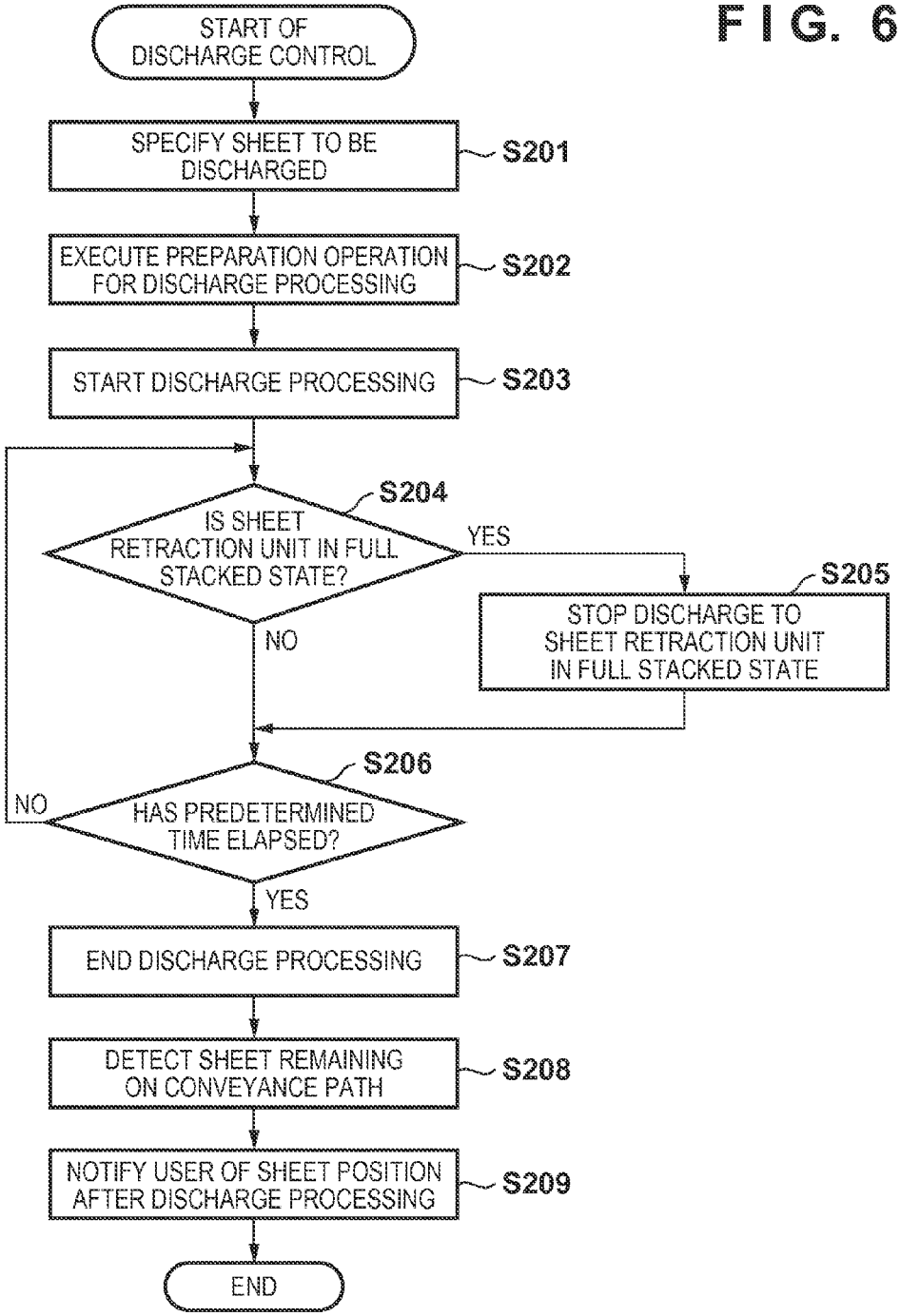
FIG. 6 is a flowchart showing the sequence of discharge control (first control example) to be executed in step S103 of FIG. 5.

FIG. 6 shows the first control example as the discharge control to be executed in step S103. First, in step S201, the CPU 201 specifies, of sheets remaining on the conveyance paths 106, sheets dischargeable to the sheet retraction units 107 to 109. In the embodiment, for example, such sheets are specified by using the aforementioned plurality of sensors arranged along the conveyance paths 106. The CPU 201 specifies the positions of the plurality of sheets remaining on the conveyance paths 106 based on signals output from the plurality of sensors. Note that the CPU 201 can receive signals output from the sensors arranged in the feed accessory 102 and discharge accessories 103 to 105 via the CPUs 211, 221, and 231.

If a jam occurs in a section between the position of a specified sheet and the position of one sheet retraction unit present on the downstream side in the conveyance direction on the conveyance path 106, the sheet can be neither conveyed nor discharged to the sheet retraction units 107 to 109, as described above. Considering this, the CPU 201 specifies, as a dischargeable sheet, a sheet conveyable to one of the sheet retraction units 107 to 109 without passing through a jam occurrence position when conveying sheets in the conveyance direction from positions specified by using the plurality of sensors on the conveyance paths 106.

In the embodiment, for example, discharge control is performed to discharge respective sheets specified to be dischargeable, from positions specified by using the plurality of sensors in the above-described way to the nearest sheet retraction units on the downstream side in the conveyance direction among the sheet retraction units 107 to 109. In this case, the flappers 111 and 112 are opened. Further, rollers (necessary rollers among the roller group 113, rollers 110, and the like) necessary to convey dischargeable sheets to the sheet retraction units 107 to 109 on the conveyance paths 106 are operated (rotated).

In step S202, the discharge control unit 302 (CPU 201) executes a preparation operation for discharge processing to retract each sheet specified in step S201 to one of the sheet retraction units 107 to 109. More specifically, the discharge control unit 302 transmits a discharge preparation command via the I/F 204 to the discharge control units 312, 322, and 332 (of the feed accessory 102 and discharge accessories 103 to 105). The discharge control unit 302 performs the preparation operation for sheet discharge processing even in the printing apparatus main body 101. In accordance with the discharge preparation command, the discharge control units 312 and 332 control the flapper control units 314 and 334 to open the flappers 111 and 112 as the preparation operation for sheet discharge processing.

In step S203, the discharge control unit 302 starts discharge processing to retract each sheet specified in step S201 to one of the sheet retraction units 107 to 109. More specifically, the discharge control unit 302 transmits a discharge start command via the I/F 204 to the discharge control units 312, 322, and 332 (of the feed accessory 102 and discharge accessories 103 to 105). The discharge control units 312, 322, and 332 control the roller control units 313, 323, and 333 to start the operations of rollers, out of rollers contained in the roller group 113, necessary to convey each sheet specified in step S201 to one of the sheet retraction units 107 to 109. Also, the discharge control unit 302 starts the operations of necessary rollers out of the rollers contained in the roller group 113. When discharging a sheet to the sheet retraction unit 108 in the printing apparatus main body 101, the discharge control unit 302 starts the operation of the rollers 110. At this time, the rollers contained in the roller group 113 are controlled to be rotated in the sheet feed direction (conveyance direction) when normal print processing is executed. Also, the rollers 110 are controlled to be rotated in a direction in which a sheet is conveyed to the sheet retraction unit 108.

In step S204, the discharge control unit 302 (CPU 201) controls the sensor control units 305, 315, and 335 to detect the stacked states of sheets on the sheet retraction units 107, 108, and 109 by using the sensors 121, 122, and 123. If the sensor control unit 305 detects, by using the sensor 122, that the stacked state of sheets on the sheet retraction unit 108 has reached the full stacked state, it notifies the discharge control unit 302 of the detection result. If the sensor control units 315 and 335 detect that the stacked states of sheets on the sheet retraction units 107 and 109 have reached the full stacked state, they notify the discharge control unit 302 of the detection results via the discharge control units 312 and 332.

Based on the notified detection results, the discharge control unit 302 determines whether the sheet retraction units 107 to 109 have become the full stacked state. If the discharge control unit 302 determines that the sheet retraction unit has become the full stacked state, it advances the process to step S205. If the discharge control unit 302 determines that the sheet retraction unit has not become the full stacked state, it advances the process to step S206.

In step S205, the discharge control unit 302 stops discharge of a sheet to the sheet retraction unit detected to have become the full stacked state. In addition, the discharge control unit 302 changes the discharge destination of the sheet to be conveyed to the sheet retraction unit, to a sheet retraction unit on the further downstream side in the conveyance direction. For example, the discharge destination of a sheet to be conveyed to the sheet retraction unit detected to have become the full stacked state is changed to the nearest sheet retraction unit (for example, the sheet retraction unit 109 when the sheet retraction unit 108 becomes the full stacked state) on the downstream side in the conveyance direction from this sheet retraction unit. As detailed discharge control, the discharge control unit 302 closes a flapper corresponding to the sheet retraction unit detected to have become the full stacked state, or controls the operation of each roller (the roller 110 or the like), so as to discharge the sheet to the sheet retraction unit after changing the discharge destination.

However, when a jam occurs between the sheet retraction unit detected to have become the full stacked state, and the sheet retraction unit serving as the changed discharge destination, no sheet can be conveyed to the sheet retraction unit serving as the changed discharge destination. In this case, the discharge control unit 302 stops conveyance of a sheet whose discharge destination has been changed. This can prevent further worsening of the generated jam state. When the stacked state of sheets on the sheet retraction unit 109 is detected to be the full stacked state, there is no sheet retraction unit on the further downstream side in the conveyance direction. In this case, the discharge control unit 302 performs discharge control to set, as the discharge destination of a sheet to be conveyed to the sheet retraction unit 109, the final discharge destination in the discharge accessory 105.

In step S205, the sheet retraction unit detected to have become the full stacked state may be displayed on the UI 205 to prompt the user to remove sheets from the sheet retraction unit. If sheets are removed from the sheet retraction unit in the full stacked state while discharge processing continues, discharge of sheets remaining on the conveyance path 106 to this sheet retraction unit may resume.

In step S206, the discharge control unit 302 determines whether a predetermined time has elapsed after the start of sheet discharge processing in step S203. The predetermined time is defined as the time taken for each sheet, which is specified in step S201 and remains on the conveyance path 106, to reach one of the sheet retraction units 107 to 109 serving as the retraction destination. If the discharge control unit 302 determines in step S206 that the predetermined time has elapsed, it advances the process to step S207.

In step S207, the discharge control unit 302 ends the sheet discharge processing. More specifically, the discharge control unit 302 transmits a discharge end command to the discharge control units 312, 322, and 332 via the I/F 204, and ends the discharge processing in the printing apparatus main body 101. Upon receiving the discharge end command, the discharge control units 312, 322, and 332 control the roller control units 313, 323, and 333 to stop the operations of the rollers contained in the roller group 113. In addition, the discharge control unit 302 controls the roller control unit 303 to stop the operations of the rollers contained in the roller group 113 and the rollers 110.

Then, in step S208, the jam detection control unit 301 executes detection processing for sheets remaining on the conveyance paths 106 in order to specify the positions of the sheets remaining on the conveyance paths 106 after the sheet discharge in steps S202 to S207. The sheets remaining on the conveyance paths 106 include a jammed sheet, and sheets which have been neither specified in step S201 nor discharged to any one of the sheet retraction units 107 to 109 and remain on the conveyance paths 106.

In step S208, the jam detection control unit 301 transmits a sheet detection command via the I/F 204 to the jam detection control units 311, 321, and 331 (of the feed accessory 102 and discharge accessories 103 to 105), and receives, as responses, information representing sheet detection results. The detection results contain information representing the positions of respective sheets remaining on the conveyance paths 106. Note that the jam detection control units 311, 321, and 331 specify the positions of these sheets by detecting these sheets using the above-mentioned sensors. Furthermore, the jam detection control unit 301 specifies the position of each sheet by detecting the sheet remaining on the conveyance path 106 in the printing apparatus main body 101 by using the above-mentioned sensor.

Finally in step S209, the jam detection control unit 301 notifies, based on the obtained information, the user of the positions of the sheets after the discharge processing. This notification is performed by displaying, for example, on the UI 205, information representing the positions of the sheets after the discharge processing. This prompts the user to remove the sheets in the printing apparatus 100.

More specifically, the jam detection control unit 301 displays, on the UI 205, the positions of sheets including a jammed sheet that have not been discharged to the sheet retraction units 107 to 109 and remain on the conveyance paths 106. This display notifies the user of the positions on the conveyance paths 106 from which the sheets should be further removed. Therefore, the user can appropriately remove the sheets remaining on the conveyance paths 106.

Note that the jam detection control unit 301 may notify the user of a sheet retraction unit (that is, one or more of the sheet retraction units 107 to 109) to which a sheet specified in step S201 has been discharged in the discharge processing in steps S202 to S207. Note that the notification about the sheet retraction units 107 to 109 may be performed by display on the UI 205 and also by display control of LEDs or the like arranged in the sheet retraction units 107 to 109. This enables the user to know one of the sheet retraction units 107 to 109 from which sheets after automatically discharging sheets from the conveyance paths 106 should be removed.

According to this example, further discharge of a sheet to a sheet retraction unit which has become the full stacked state can be prevented. Thus, occurrence of an additional jam owing to the full stacked state of the sheet retraction unit can be prevented.

Modification of First Control Example

Figure 7:
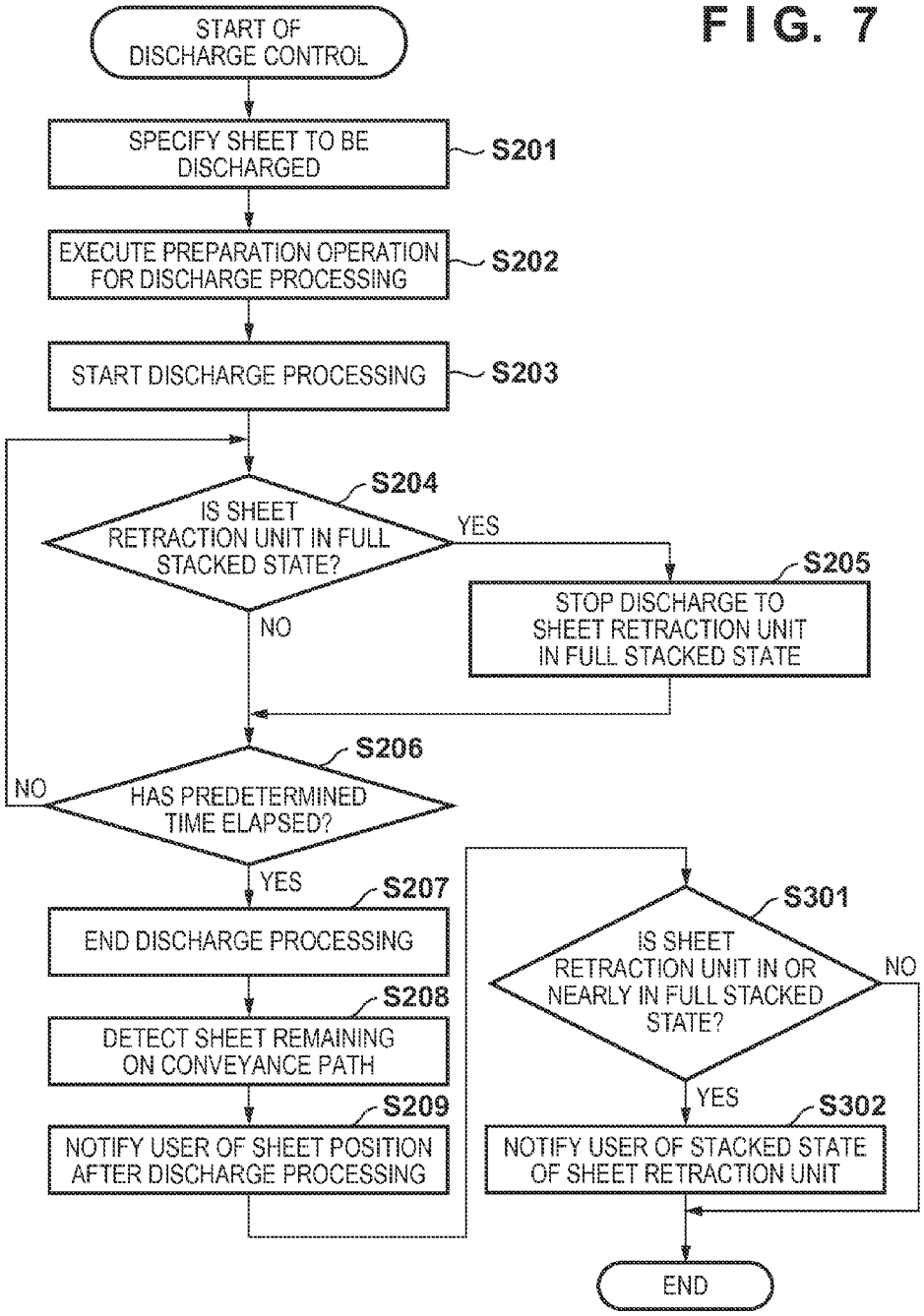
FIG. 7 is a flowchart showing the sequence of discharge control (first control example) to be executed in step S103 of FIG. 5.

FIG. 7 shows a modification of the first control example as discharge control to be executed in step S103. This example is different from the example shown in FIG. 6 in that steps S301 and S302 are executed after step S209, as shown in FIG. 7. Note that steps S201 to S209 are the same as those in FIG. 6, and a description thereof will not be repeated for simplification.

In step S301, the jam detection control unit 301 (CPU 201) determines the stacked states of sheets on the sheet retraction units 107 to 109 based on the results of detection using the sensors 121 to 123. More specifically, for each of the sheet retraction units 107 to 109, the jam detection control unit 301 determines whether the stacked state of sheets is the full stacked state or nearly the full stacked state. If the jam detection control unit 301 determines that one of these sheet retraction units is in or nearly in the full stacked state, it advances the process to step S302; if NO, it ends the process. Note that nearly the full stacked state is a state in which when a jam occurs next time and a sheet is discharged to a specific sheet retraction unit, this sheet retraction unit may become the full stacked state.

In step S302, the jam detection control unit 301 displays, on the UI 205, the stacked state of the sheet retraction unit determined to have been in or nearly in the full stacked state, thereby notifying the user to remove sheets stacked on the sheet retraction unit.

In this example, occurrence of an additional jam owing to the full stacked state of the sheet retraction unit can be prevented. Also, the sheet retraction unit can be prevented as much as possible from becoming the full stacked state in discharge control to be executed when a jam occurs next time.

Second Control Example

Figure 8:
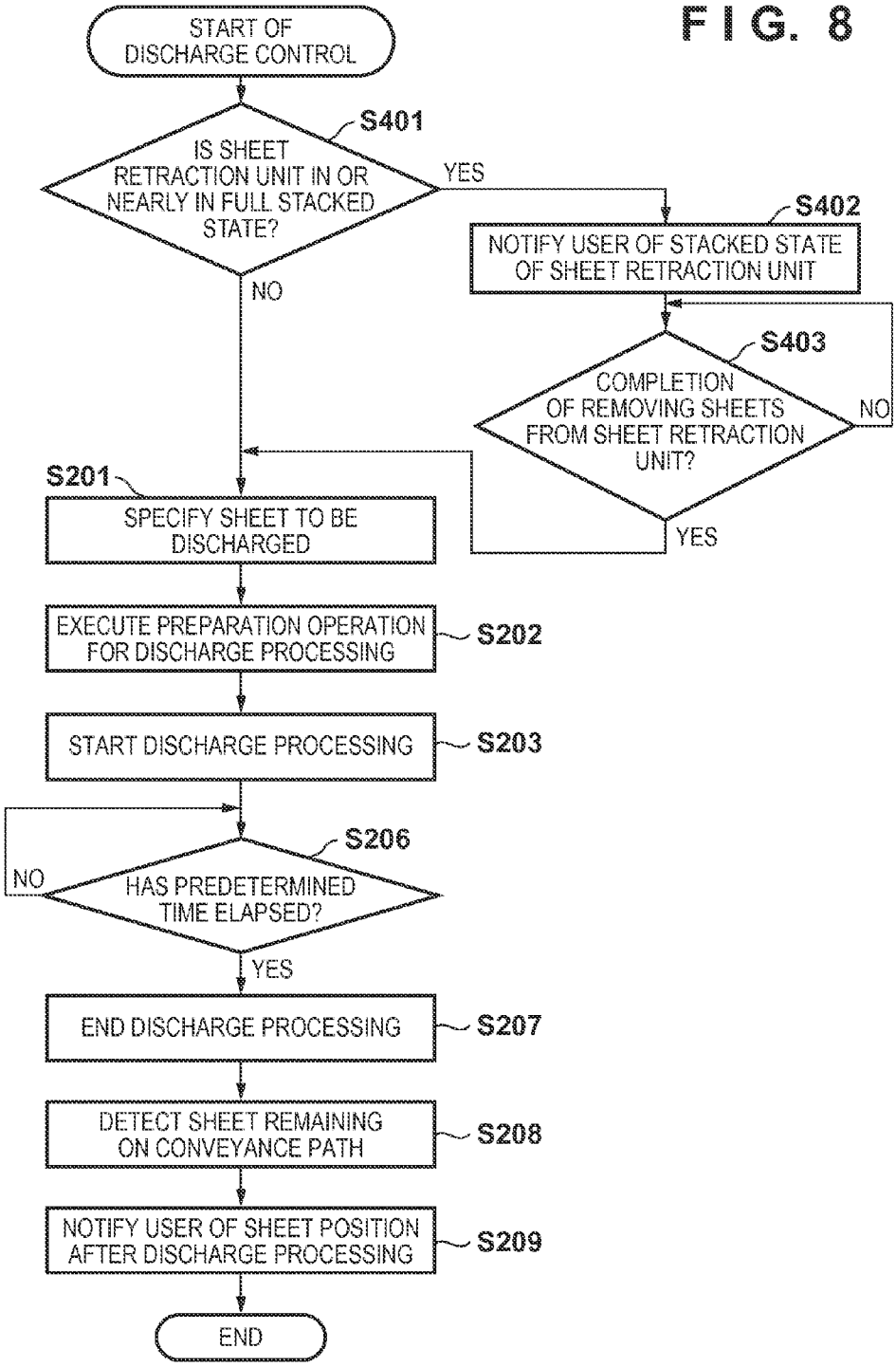
FIG. 8 is a flowchart showing the sequence of discharge control (second control example) to be executed in step S103 of FIG. 5.

FIG. 8 shows the second control example as the discharge control to be executed in step S103. In the second control example, unlike the above-described first control example, before the start of discharging (retracting) sheets remaining on the conveyance paths 106, the user is prompted to remove sheets stacked in advance from a sheet retraction unit which has been in or nearly in the full stacked state. With this processing, the stacked state of the sheet retraction unit can be prevented from becoming the full stacked state after the start of sheet discharge processing. Thus, occurrence of an additional jam can be prevented. This example is different from the first control example shown in FIG. 6 in that steps S401 to S403 are executed before step S201, and steps S204 and S205 are not executed, as shown in FIG. 8. Note that steps S201 to S203 and steps S206 to S209 are the same as those in FIG. 6, and a description thereof will not be repeated for simplification.

After the discharge control in step S103 starts, the jam detection control unit 301 (CPU 201) determines in step S401, for each of the sheet retraction units 107 to 109, whether the stacked state of sheets is the full stacked state or nearly the full stacked state, as in step S301. If the jam detection control unit 301 determines that one of these sheet retraction units is in or nearly in the full stacked state, it advances the process to step S402; if NO, it advances the process to step S201.

In step S402, the jam detection control unit 301 displays, on the UI 205, the stacked state of the sheet retraction unit determined to have been in or nearly in the full stacked state, thereby notifying the user to remove sheets stacked on the sheet retraction unit. In step S403, the jam detection control unit 301 determines whether the removal of sheets stacked on the sheet retraction unit has been completed. If the removal has not been completed, the jam detection control unit 301 repeats the determination. If the removal has been completed, the jam detection control unit 301 advances the process to step S201.

In this example, by the processes in steps S401 to S403, the sheet retraction units 107 to 109 can be prevented from becoming the full stacked state while discharging sheets remaining on the conveyance paths 106. Hence, the processes in steps S204 and S205 need not be executed, unlike the first control example.

In this example, the sheet retraction units 107 to 109 can be prevented from becoming the full stacked state during execution of sheet discharge processing, and occurrence of a jam owing to the full stacked state of the sheet retraction unit can be prevented. Note that the above-described first control example, its modification, and the second control example can be appropriately combined and practiced.

As described above, according to the embodiment, when a jam occurs, the user can remove at once most of sheets remaining on the conveyance paths 106 from the sheet retraction units 107 to 109. More specifically, sheets can be removed at once from the sheet retraction units 107 to 109, except for a physically jammed sheet on the conveyance path 106, and sheets which could not be automatically discharged. This can reduce the labor of the user required to remove sheets upon occurrence of a jam.

Further, according to the embodiment, the sheet retraction units 107 to 109 can be prevented from becoming the full stacked state while sheets remaining on the conveyance paths 106 are discharged to the sheet retraction units 107 to 109 upon occurrence of a jam. This can prevent occurrence of a new jam owing to the full stacked states of the sheet retraction units 107 to 109.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-102594, filed May 14, 2013, which is hereby incorporated by reference herein in its entirety.

What is claimed is:

1. A printing apparatus comprising:

a plurality of stacking units each configured to be used as a discharge destination of a remaining sheet which remains on a conveyance path when a sheet jam occurs on the conveyance path, the plurality of stacking units including at least a first stacking unit and a second stacking unit;

a discharge control unit configured to perform a control to, when the sheet jam occurs on the conveyance path, discharge the remaining sheet to one of the plurality of stacking units; and a detection unit configured to detect a stacked state of sheets of each of the plurality of stacking units, wherein the discharge control unit is configured to perform the control to discharge the remaining sheet to the first stacking unit which is closest to the remaining sheet among stacking units positioned on a downstream side of the remaining sheet in a case where the stacked state of the first stacking unit detected by the detection unit does not indicate a full state, and to perform the control to discharge the remaining sheet to the second stacking unit which is closest to the first stacking unit among stacking units positioned on a downstream side of the first stacking unit in a case where the stacked state of the first stacking unit detected by the detection unit indicates a full state.

2. The printing apparatus according to claim 1, further comprising a notification unit configured to notify, in a case where the remaining sheet is not discharged by the discharge control unit, a user of a position where the remaining sheet remains.

3. The printing apparatus according to claim 1, further comprising a printing unit configured to print an image on a sheet, wherein one of the plurality of stacking units is positioned on an upstream side of the printing unit.

4. The printing apparatus according to claim 3, wherein one of the plurality of stacking units is positioned on a downstream side of the printing unit.

5. A method of controlling a printing apparatus, the printing apparatus including a plurality of stacking units each configured to be used as a discharge destination of a remaining sheet which remains on a conveyance path when a sheet jam occurs on the conveyance path, and the plurality of stacking units including at least a first stacking unit and a second stacking unit, the controlling method comprising:

performing a control to, when the sheet jam occurs on the conveyance path, discharge the remaining sheet to one of the plurality of stacking units; and detecting a stacked state of sheets of each of the plurality of stacking units, wherein, the control is performed such that the remaining sheet is discharged to the first stacking unit which is closest to the remaining sheet among stacking units positioned on a downstream side of the remaining sheet in a case where the detected stacked state of the first stacking unit does not indicate a full state, and is discharged to the second stacking unit which is closest to the first stacking unit among stacking units positioned on a downstream side of the first stacking unit in a case where the detected stacked state of the first stacking unit indicates a full state.

6. A non-transitory computer-readable storage medium storing a program that causes a computer to perform a method for controlling a printing apparatus, the printing apparatus including a plurality of stacking units each configured to be used as a discharge destination of a remaining sheet which remains on a conveyance path when a sheet jam occurs on the conveyance path, and the plurality of stacking units including at least a first stacking unit and a second stacking unit, the method comprising:

performing a control to, when the sheet jam occurs on the conveyance path, discharge the remaining sheet to one of the plurality of stacking units; and detecting a stacked state of sheets of each of the plurality of stacking units, wherein, the control is performed such that the remaining sheet is discharged to the first stacking unit which is closest to the remaining sheet among stacking units positioned on a downstream side of the remaining sheet in a case where the detected stacked state of the first stacking unit does not indicate a full state, and is discharged to the second stacking unit which is closest to the first stacking unit among stacking units positioned on a downstream side of the first stacking unit in a case where the detected stacked state of the first stacking unit indicates a full state.

* * * * *